US005806817A

United States Patent [19]

Loud

[11] Patent Number: 5,806,817

[45] Date of Patent: Sep. 15, 1998

[54] ATTACHMENT DEVICE FOR A LADDER

[75] Inventor: Bruce K. Loud, 5012 Magoun Ave., East Chicago, Ind. 46312

[73] Assignees: Bruce K. Loud, East Chicago; IIDLLC, both of Ind.

[21] Appl. No.: 634,816

[22] Filed: Apr. 19, 1996

[51] Int. Cl.[6] ..... E06C 7/14

[52] U.S. Cl. ..... 248/210; 248/238

[58] Field of Search ..... 248/210, 211, 248/238

[56] References Cited

U.S. PATENT DOCUMENTS

| | | | |
|---|---|---|---|
| 2,635,797 | 4/1953 | Siebert | 248/211 |
| 3,163,389 | 12/1964 | Thornburgh | 248/211 |
| 3,474,996 | 10/1969 | Stamn | 248/210 |
| 3,630,251 | 12/1971 | Ross | 220/751 |
| 3,738,601 | 6/1973 | Gehringer | 248/210 |
| 4,205,411 | 6/1980 | Cupp et al. | 15/257.06 |
| 5,276,943 | 1/1994 | Ludy | 16/126 |
| 5,402,910 | 4/1995 | Pilney | 220/751 |
| 5,429,205 | 7/1995 | Collins | 248/238 |

*Primary Examiner*—Leslie A. Braun
*Assistant Examiner*—Willie Berry, Jr.
*Attorney, Agent, or Firm*—Gary M. Hartman; Domenica N. S. Hartman

[57] ABSTRACT

An attachment device securable to a ladder having a series of rungs. The device includes a container having a bottom and sidewall attached to its bottom so as to form an interior compartment in which materials and/or objects can be contained, such as a paint can, brushes, and related items. The device also includes hanging members pivotably attached to the container for hanging the container from a first rung of the series of rungs, an adjustment feature associated with the hanging members for adjustably altering the length of the hanging members so as to enable adjustment of a distance between the container and the first rung from which the container is suspended, a locking feature associated with the hanging members for selectively disabling the ability of the hanging members to pivot relative to the container in order to maintain a desired angle for the container relative to the ladder, and a feature on the bottom of the container for abutting an adjacent lower rung of the series of rungs so as to secure the container to the adjacent lower rung.

18 Claims, 2 Drawing Sheets

ATTACHMENT DEVICE FOR A LADDER

The present invention generally relates to devices for attaching containers to ladders. More particularly, this invention is directed to a paint can attachment device that allows a paint can to be securely attached to a ladder while also allowing for easy access to the contents of the paint can.

BACKGROUND OF THE INVENTION

Containers for holding materials and objects must often be specially adapted to permit their use in various applications while maintaining easy access to their contents. For certain applications, an attachment or mounting device may be required that is specialized to effectively operate within the unique constraints under which the container must be used. One such condition that has required the use of a unique attachment has been when it is desired to attach a container to a ladder, and where easy access to the container's contents is particularly important. When working on a ladder, easy access to the contents promotes the ability of the user to complete a task without creating a potentially hazardous situation due to struggling with the container in order to gain access to its contents. Besides enabling ready access, such devices must be able to securely hold the container upright to prevent spillage of its contents. This problem can become particularly troublesome when the contents are a fluid, such as paint.

Several devices have been suggested in the prior art for attaching containers to ladders. For example, U.S. Pat. No. 3,163,389 to Thornburgh suggests a bracket that allows a paint can to be hung from a rung of a ladder. Though the bracket readily permits a paint can to be mounted on a ladder and enables ready access to the can's contents, the bracket is limited in application because it must be used with a paint can having an attached handle and a flange on the perimeter of the can's base. A container disclosed in U.S. Pat. No. 5,402,910 to Pilney has a handle adapted to suspend the container from a ladder rung. Pilney's container is more versatile since it can be used to retain objects other than paint cans. However, Pilney's handle permits the container to pivot freely on a ladder rung. While potentially promoting access to the contents of the container, the propensity to pivot increases the likelihood that the container's contents will fall out of the container. At minimum, the loss of the container's contents is an inconvenience to the user, and if the contents are a liquid such as paint, a spill could result in a substantial loss of liquid and possibly cause damage to surrounding objects. Another drawback is that access to the container's contents can be impeded, because Pilney's handle is adapted to suspend the container substantially beneath a ladder when the ladder is inclined and leaning against a wall. As a result, the user is forced to reach through the rungs of the ladder to be able to gain access to the contents of the container.

To overcome these obstacles, the prior art has suggested several devices configured to promote both the stability of a container and ready access to its contents. For example, U.S. Pat. No. 4,205,411 to Cupp et al. suggests a paint tray that is attachable between the rungs of a ladder using a bail that suspends the tray from one rung while the bottom of the tray abuts against the next lower rung. Similarly, U.S. Pat. No. 5,276,943 to Ludy discloses a paint can handle that enables a paint can to be secured between two adjacent rungs of a ladder. Unlike the devices of Thornburgh and Pilney, the devices of Cupp et al. and Ludy provide extra security by inhibiting the ability of their containers to pivot. However, the added stability provided by these devices is achieved in such a way that also inhibits access to the contents, because both of these containers are adapted to hang beneath and/or behind the ladder and cannot be controllably pivoted to an orientation that promotes access to their contents. The devices disclosed by Cupp et al. and Ludy are also limited because of the manner in which they engage two adjacent rungs to provide stability. Because the distance between the hanging member and the bottom of the container is fixed in these devices, they cannot be readily adapted for use where the vertical distance between adjacent ladder rungs substantially varies, either because of the particular ladder design or due to the degree to which the ladder is inclined during use.

In light of the above, it can be appreciated that it would be desirable if a container attachment device were available for use with a ladder that provided both stability and easy access to the container's contents. More particularly, it would be desirable to have a device that allows fluids, materials and/or objects to be conveniently stored and removed as needed, that can be attached in any location on a ladder to provide ready access to its contents, and that promotes the stability of the container regardless of the degree to which a ladder is inclined.

SUMMARY OF THE INVENTION

It is an object of this invention to provide a device that can be readily secured to a ladder.

It is a further object of this invention that such a device is adapted to receive a container and support the container relative to the ladder so as to enable ready access to contents within the container.

It is another object of this invention that such a device enables the orientation of the container on the ladder to be selectively altered and then maintained to prevent spillage of its contents.

In accordance with this invention, a device is provided that can be readily secured to a ladder having a series of rungs. The device includes a container having a bottom and sidewall attached to its bottom so as to form an interior compartment in which materials and/or objects can be received, such as a paint can, brushes, and related items. The device also includes hanging members pivotably attached to the container for suspending the container from a first rung of the ladder, an adjustment feature associated with the hanging members for adjustably altering the length of the hanging members so as to enable adjustment of the distance between the container and the rung from which the container is suspended, a locking feature associated with the hanging members for selectively disabling the ability of the hanging members to pivot relative to the container, and a feature on the bottom of the container for abutting an adjacent lower rung of the ladder so as to secure the container to the adjacent lower rung.

The hanging members can be formed to include a hook or similar feature for suspending the container from a rung. Uniquely, the hanging members are adjustable in two ways. First, the effective length of the hanging members can be adjusted with the adjustment feature to adapt to different distances between the adjacent rungs of a ladder. Secondly, the angular orientation of the hanging members relative to the container can be adjusted to alter the position and orientation of the container relative to the ladder. The desired orientation of the container can then be maintained with the locking feature, such that the container will remain in its desired orientation until readjusted. Each of the above adjustments is facilitated by the abutting feature, which enables the position of the container on the ladder to be positively established relative to the two adjacent rungs with which the device is engaged. In so doing, the position of the container between the rungs can be readily altered to promote ready access to its contents, while attributing considerable stability to the container.

From the above, it is apparent that a significant advantage of this invention is that it provides a container with which various materials and/or objects can be supported on a ladder. In use as a receptacle for a paint can, the user can quickly substitute cans without having to specifically attach and detach the device from the handle or base of a can. Another significant advantage to this invention is that it promotes access to the contents of the container. Rather than the container hanging vertically downward beneath a ladder, the device of this invention enables the container to be positively positioned relative to two adjacent rungs of the ladder. As such, the container can be securely positioned on the same side of the ladder as the user, such that the user does not have to reach through the rungs to gain access to its contents. This is particularly desirable where the contents of the container are a paint can and various tools used when painting. Another advantage of this invention is that the container is securely attached to the ladder in a manner that enables the container to be maintained in any desired position and orientation relative to the ladder regardless of the spacing between adjacent rungs and the angle of inclination of the ladder.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

Figure 1:
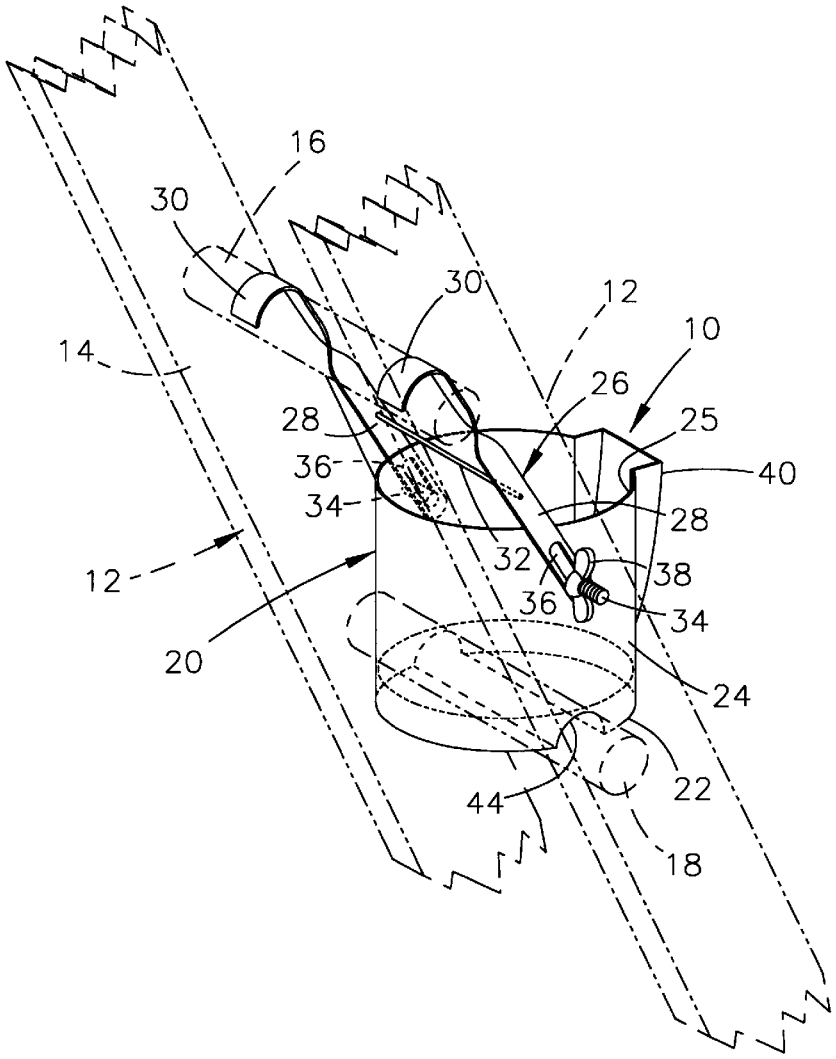
FIG. 1 is a perspective view of an attachment device mounted on a ladder in accordance with a preferred embodiment of this invention.
Figure 2:
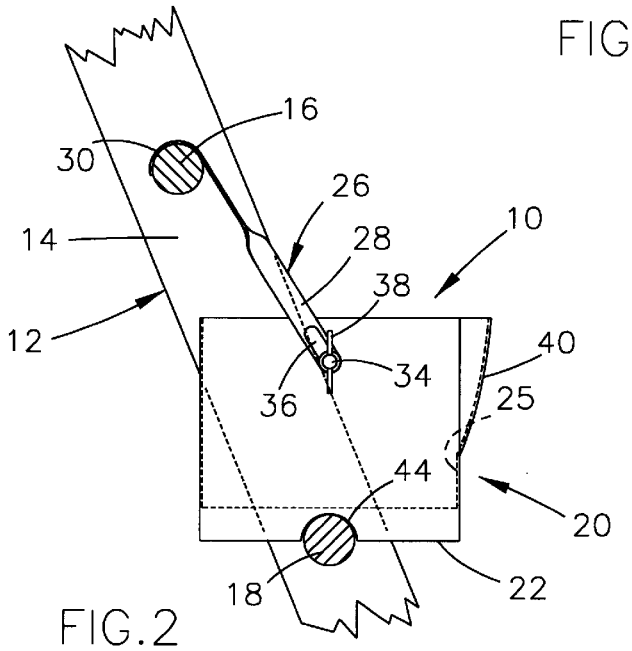
FIG. 2 is a side view of the attachment device shown in FIG. 1.

Shown in FIGS. 1 and 2 is an attachment device 10 in accordance with a preferred embodiment of this invention. The device 10 is shown as being attached to a ladder 12 having a series of rungs between two parallel legs 14. As shown in FIGS. 1 and 2, the device 10 is retained in place on the ladder 12 by being secured to adjacent upper and lower rungs 16 and 18 of the ladder 12. The device 10 includes a container 20 having a bottom 22 and a sidewall 24 attached along the periphery of the bottom 22, thus forming an internal cavity 25 within which materials and/or objects may be retained. In a preferred embodiment, the sidewall 24 of the container 20 have a roughly circular cross-section, such that the cavity 25 generally has a cylindrical shape. In addition, the container 20 is preferably shaped to include a trough 40 recessed into the sidewall 24 of the container 20. The trough 40 is provided to enable objects to be placed in the container 20 along with an object that otherwise occupies the entire cavity 25 of the container 20. For example, when the device 10 is used by a painter, a paint brush can be placed in the trough 40 while the remainder of the cavity 25 is occupied by a paint can. Though a preferred shape for the container 20 is shown as being cylindrical in the Figures, it will be apparent that the container 20 can have any suitable shape.

With further reference to FIGS. 1 and 2, the device 10 is adapted to enable the container 20 to be attached to the first rung 16 by an adjustable hanger 26 that includes a pair of arms 28. Preferably, each arm 28 has an arcuate portion 30 disposed at one distal end thereof with which the container 20 is secured to the upper rung 16. In a preferred embodiment, the arcuate portion 30 has a radius of curvature roughly equal to that of the upper rung 16. As shown in FIG. 1, the adjustable hanger 26 further includes a cross member 32 connected between the arms 28 such that the arms 28 are maintained parallel to each other. The cross member 32 also serves as a handle for the container 20.

Figure 3:
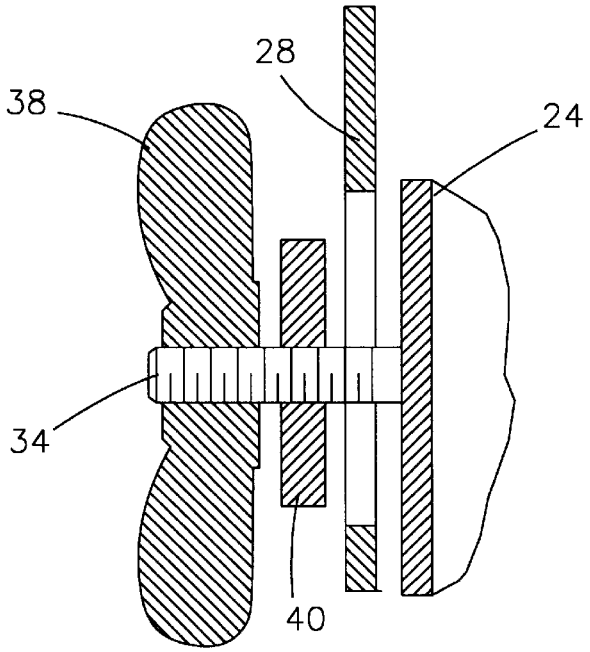
FIG. 3 shows a fragmented cross-sectional view showing the manner in which an adjustable handle is mounted to the attachment device.

A unique feature of this invention is the adjustability of the hanger 26 provided by the manner in which the arms 28 are secured to the container 20. As can best be appreciated with reference to FIG. 3, the arms 28 are attached to the sidewall 24 of the container 20 by a pair of threaded studs 34 that extend outwardly from opposite sides of the container 20. Each of the studs 34 is received within an elongate slot 36 formed at the lower end of each arm 28, so as to enable the effective lengths of the arms 28 to be adjusted relative to the container 20 by adjusting the positions of the studs 34 within their respective slots 36. Once in a desired position, the arms 28 can be retained in place by suitable locking members, such as the wingnuts 38 and lock washers 40 shown in the Figures. The wingnuts 38 enable the user to quickly alter the position of the arms 28 as desired by hand, and therefore facilitate the process of adjusting the orientation and effective length of the arms 28 through the steps of loosening the wingnuts 38, adjusting the arms 28, and then retightening the wingnuts 38 to fix the arms 28 relative to the container 20.

Figure 4:
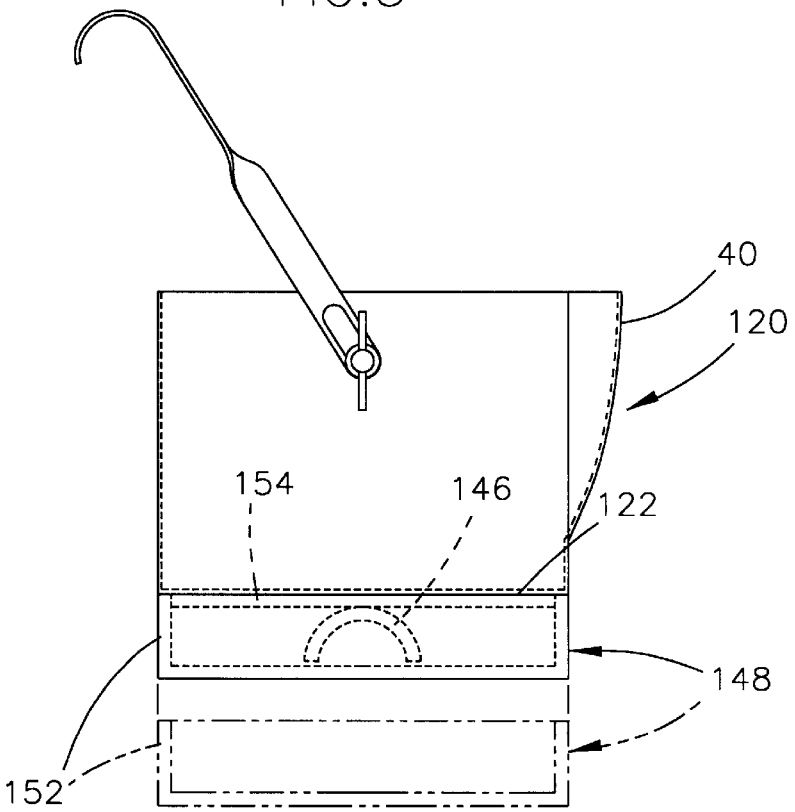
FIG. 4 shows an alternate embodiment of this invention.

The adjustability of the hanger 26 enables the container 20 to be selectively oriented and positioned relative to the ladder 12 in cooperation with a suitable feature that stabilizes the container 20 relative to the lower rung 18 of the ladder 12. FIGS. I and 2 show a preferred embodiment of this invention, in which a recess 44 is formed in the bottom 22 of the container 20. The recess 44 is sized to accommodate the lower rung 18 such that the container 20 will resist being dislodged from the lower rung 18. Alternatively, a separate member 146 can be attached to the bottom 122 of a container 20 in accordance with a second embodiment of this invention, illustrated in FIG. 4. To enable the container 120 to rest in an upright position, this embodiment includes a base 148 having sidewall 152 that form a recess sized to receive the member 146. Preferably, the sidewall 152 are spaced apart such that an interference fit can be achieved with a recessed annular lip 154 formed at the perimeter of the bottom 122 of the container 120.

With reference again to the embodiment of FIGS. 1 and 2, the container 20 as described is supported relative to two fixed points on the ladder, i.e., the rungs 16 and 18. Furthermore, the adjustability of the hanger 26, in terms of the angular orientation of the arms 28 relative to the container 20 and the effective length of the arms 28, enables the container 20 to be selectively positioned relative to the ladder 12, and then maintained in that position with the wingnuts 38. As shown in FIGS. 1 and 2, a preferred position for the container 20 is on the front side of the ladder 12, such that a person on the ladder 12 has ready access to the interior 25 of the container 20. As is apparent from FIG. 2, the angular orientation of the arms 28 alone would not ensure that the cavity 25 of the container 20 is accessible from the front of the ladder 12, since the vertical spacing between adjacent rungs 16 and 18 is dependent on the spacing of the rungs 16 and 18 along the length of the ladder 12, as well as the degree to which the ladder 12 is inclined. It is only through the ability to adjust the effective lengths of the arms 28 and the orientation of the arms 28 relative to the container 20, and then maintain such adjustments through the wingnuts 38 or another suitable locking device, does this capability become possible.

In view of the above, it can be seen that the attachment device 10 of this invention provides the user with ready access to the contents of the container 20. By providing adjustability of the hanger 26, both in the lengths of the arms 28 and their angular orientation of the arms 28 relative to the container 20, the user can readily adjust the device 10 to avoid having to reach through the rungs 16 and 18 of the ladder 12 in order to gain access to the contents of the container 20. Furthermore, the device 10 is positively secured between the rungs 16 and 18, such that the device 10 can be adapted for use on different ladders whose spacing between adjacent rungs may differ. This aspect of the invention also enables the device 10 to be adjusted to accommodate any inclination of the ladder 12, yet maintain the container 20 on the same side of the ladder 12 as the user. Once appropriately adjusted, the container 20 is securely maintained in place through the cooperation of the slots 36 in the arms 28, the threaded studs 34 and the wingnuts 38. When the position of the container 20 must be adjusted, the user can quickly perform this task by loosening the wingnuts 38, extending or retracting the arms 28 such that the threaded studs 34 slide within their slots 36, and then retightening the wingnuts 38 until the arms 28 are fixed in place between the wingnuts 38 and the sidewall 24 of the container 20. As such, the device 10 of this invention is extremely easy to use and greatly facilitates essentially any task performed on a ladder.

While our invention has been described in terms of a preferred embodiment, it is apparent that other forms could be adopted by one skilled in the art, such as by incorporating the novel features of this invention with other similar container attachment device that structurally differ from that shown in the figures. Accordingly, the scope of our invention is to be limited only by the following claims.

What is claimed is:

1. A device for use with a ladder having a series of rungs, the device comprising:

a container having a bottom, a sidewall attached to the bottom and defining an interior surface of the container, and a trough recessed into the interior surface;

means pivotably attached to the container for positioning the container relative to a first rung of the series of rungs while the container is supported on and over a second rung below the first rung;

adjustment means associated with the positioning means for adjustably altering an effective length of the positioning means so as to enable adjustment of a distance between the container and the first rung;

means associated with the positioning means for selectively preventing the positioning means from pivoting relative to the container; and means associated with the container for abutting the second rung so as to stabilize the container on the second rung;

wherein the positioning means and the container are configured to support the container above the ladder when the ladder is inclined.

2. A device as recited in claim 1 wherein the positioning means comprises a pair of slots, and wherein the adjustment means comprises:

an oppositely-disposed pair of members extending outwardly from the sidewall of the container, the pair of members being individually coupled with the pair of slots of the positioning means; and locking means coupled to each of the pair of members, the locking means being operable to selectively prevent the positioning means from rotating relative to the container.

3. A device as recited in claim 1 wherein the positioning means comprises a pair of arms, each of the pair of arms comprising:

a longitudinal axis and oppositely-disposed first and second ends;

a longitudinal slot at the first end; and means disposed at the second end for securing the device to the first rung.

4. A device as recited in claim 3 wherein the securing means is a hook disposed at the second end of each of the pair of arms.

5. A device as recited in claim 3 wherein the positioning means further comprises a cross member such that the pair of arms are fixed relative to each other.

6. A device as recited in claim 3 wherein the adjustment means comprises:

an oppositely-disposed pair of threaded members extending outwardly from the sidewall of the container, each of the pair of threaded members extending through a corresponding slot of the pair of arms; and locking means coupled to each of the pair of threaded members, the locking means being operable to selectively prevent the pair of arms from rotating relative to the container.

7. A device as recited in claim 6 wherein the locking means is movable between a locking position in which the locking means clamps a corresponding one of the pair of arms against the sidewall, and a release position in which the locking means allows a corresponding one of the pair of arms to rotate relative to the container and in which a corresponding one of the pair of threaded members is able to slide within a corresponding one of the slots.

8. A device as recited in claim 1 wherein the engaging means is an arcuate member secured to the bottom of the container.

9. A device as recited in claim 8 further comprising a base securable to the bottom of the container, the base having a recess sized to receive the arcuate member.

10. A device as recited in claim 8 wherein the base has an upwardly-extending sidewall and wherein the bottom of the container has an annular portion, the sidewall of the base and the annular portion of the container being relatively sized to provide an interference fit therebetween.

11. A device as recited in claim 1 wherein the engaging means is an arcuate-shaped recess in the bottom of the container.

12. A device as recited in claim 1 wherein the interior surface of the container is cylindrically-shaped.

13. A container attachment device for use with a ladder having a series of rungs, the device comprising:

a container having a bottom and a sidewall attached to a peripheral edge of the bottom so as to define an interior of the container, the bottom of the container having an annular portion;

a pair of arms pivotably attached to the container for positioning the container relative to a first rung of the series of rungs while the container is supported on and over an adjacent lower rung of the series of rungs, each arm of the pair of arms having a longitudinal axis, oppositely-disposed first and second ends, a longitudinal slot at the first end, and means for parallelly fixing the pair of arms relative to each other;

adjustment means associated with the pair of arms for adjustably altering an effective length of each of the pair of arms so as to enable adjustment of a distance between the container and the first rung, the adjustment means comprising an oppositely-disposed pair of members extending outwardly from the sidewall of the container, each of the pair of members extending through a corresponding slot of the pair of arms, the adjustment means further comprising locking means coupled to each of the pair of members, the locking means being operable to selectively prevent the pair of arms from rotating relative to the container and to selectively prevent the pair of members from being translated within their respective slots; and an arcuate-shaped feature centrally-located at the bottom of the container for receiving the adjacent lower rung so as to secure the container to and on the adjacent lower rung;

a base securable to the bottom of the container, the base having an upwardly-extending sidewall and having a recess sized to receive the arcuate-shaped feature, the sidewall of the base and the annular portion of the container being relatively sized to provide an interference fit therebetween;

wherein the pair of arms, the adjustment means and the container are configured to support the container above the ladder when the ladder is inclined, whereby a user of the device on the ladder is not required to reach between the first rung and the adjacent lower rung in order to gain access to the interior of the container.

14. A container attachment device as recited in claim 13 wherein the container has a cylindrically-shaped interior surface.

15. A container attachment device as recited in claim 14 wherein the container further includes a trough recessed into the interior surface.

16. A container attachment device as recited in claim 13 wherein the arcuate-shaped feature is a semicylindrical-shaped recess formed in the bottom of the container.

17. A container attachment device as recited in claim 13 wherein each of the pair of members is a threaded member, and the locking means are threadably coupled to each of the pair of threaded members.

18. A container attachment device as recited in claim 17 wherein the locking means is threadably movable between a locking position in which the locking means clamps a corresponding one of the pair of arms against the sidewall, and a release position in which the locking means allows a corresponding one of the pair of arms to rotate relative to the container and in which a corresponding one of the pair of threaded members is able to slide within a corresponding one of the slots.

* * * * *